United States Patent [19]

Whiteside

[11] Patent Number: 4,760,784

[45] Date of Patent: Aug. 2, 1988

[54] COMPACTING PLATE LOCKING DEVICE USED FOR PACKAGING EXPANSIBLE MATERIAL

[75] Inventor: Richard W. Whiteside, Florence, Ala.

[73] Assignee: Tennessee Valley Authority, Muscle Shoals, Ala.

[21] Appl. No.: 73,619

[22] Filed: Jul. 15, 1987

[51] Int. Cl.[4] ..... B30B 15/06

[52] U.S. Cl. ..... 100/220; 100/219; 100/95; 220/326; 53/526; 53/330

[58] Field of Search ..... 100/219, 220, 181, 95, 100/54, 56, 57, 59, 187; 99/349, 350, 351; 53/526, 330; 206/83.5, 499; 217/86; 220/326, 324, 323; 376/272

[56] References Cited

U.S. PATENT DOCUMENTS

| | | | |
|---|---|---|---|
| 257,454 | 5/1882 | Alexander | 100/219 |
| 548,724 | 10/1895 | Rushton | 100/219 X |
| 3,850,094 | 11/1974 | Shontz | 100/219 |
| 4,414,788 | 11/1983 | Berg | 53/527 X |
| 4,462,310 | 7/1984 | Jackson et al. | 100/219 |

*Primary Examiner*—Andrew M. Falik
*Attorney, Agent, or Firm*—Robert A. Petrusek

[57] ABSTRACT

Apparatus useful as a compacting device adapted to be inserted into a barrel or similar container either singularly, or in combination with a plurality of similar devices and generally comprising one or more compacting plates which plates are adapted to fit within such container and disposed therein for movement in a direction generally parallel to the axis of such container. A plurality of resilient locking tabs are secured to the upper surface of such compacting plates each by means of an angle bracket and in a manner so as to extend beyond both the peripheral surface of such compacting plate and the outermost edge of said angle bracket to thereby provide for engagement of said tabs with the inside of such container. When loose material is placed in the container, and a compacting plate is inserted thereinto and pressed downwardly, the material within the container and under said plate will be compacted. Said tabs are arranged and mounted in a fashion so as to prevent the reverse movement of such compacting plate such that upon withdrawal of the press, additional material can be added to the container atop of said compacting plate and a second plate can then be inserted into such container for subsequent compaction of such subsequently added material.

19 Claims, 6 Drawing Sheets

COMPACTING PLATE LOCKING DEVICE USED FOR PACKAGING EXPANSIBLE MATERIAL

INTRODUCTION

The present invention relates to a new, novel, and relatively simple and inexpensive, as well as to a highly useful and dependable apparatus eminently useful as a device for compacting generally loose materials having a variety of shapes and sizes and is particularly suited to be adapted to be inserted into a barrel or similar container either singularly, or in combination with a plurality of similar devices. Said compacting device generally comprises one or more compacting plates which are adapted to fit within the container for movement in a direction generally parallel to the axis thereof. A plurality of resilient locking tabs are secured to the upper surface of each compacting plate and are arranged thereon by means of angle brackets in a manner so as to ensure that at least a portion of said tab extends beyond the peripheral surface of the compacting plate for engagement with the inside periphery surface of the container. A principal feature of the instant invention is the additional provision that the thickness of said locking tabs is greater than the nominal dimension of the gap which exists between the outermost edge of said compacting plate angle brackets and the inside peripheral surface of the container into which said plate is introduced and subsequently pressed. Thus, when loose materials, such as, for example, paper and textile materials, are placed in the container and a compacting plate of the type of the instant invention is inserted thereinto and pressed downwardly by any suitable means, such as, for example, a press or ram, the material within the container and under said plate will be compacted. The engagement of the tabs with the inside peripheral surface of the container, by virtue of their physical characteristics and arrangement, are caused to become deformed from their original shape and become wedged between the outside edge of said compacting plate angle brackets and the inside edge of said container to thereby prevent the reverse movement of the compacting plate so that upon withdrawal of the press additional material can be added to the container for subsequent compaction by repeating the procedure supra and by the use of one or more additional compacting plates.

BACKGROUND OF THE INVENTION

1. Field of the Invention

The present invention relates to methods and means for compacting a great variety of generally loose materials into substantially rigid containers for the shipment and/or disposal thereof and is particularly useful in such applications, as for example, the compaction, shipment, and the ultimate disposal of textile-type materials which have become contaminated with relatively low levels of radiation of the nuclear type. One embodiment of the present invention is directed to a compacting device, more specifically to a compacting device adapted to be inserted in a container, wherein one or more plates are ultimately secured at various levels within the container to prevent the compacted material therein and thereunder from rebounding subsequent to the application of compression forces upon each of said compacting plates to thereby permit the introduction of additional material into said container for subsequent compaction thereof.

In any number of prior art processes of packing loose material into a container such as a barrel or a drum, a plunger or some other type compacting ram has been utilized to compress the material into the container. However, upon withdrawal of the plunger to permit the introduction of additional material thereinto, the loose material previously compacted by means of such pressing with the plunger or ram tends to springback due to such materials own natural inherent resiliency and thereby limits the amount of additional material which can be added to the container. In order to increase the capacity of a container, it has been known in the past to insert spikes or pins through the sides of the container into the compacted material adjacent the plunger while the material is in the fully compacted condition. Upon withdrawal of the plunger, to permit the introduction of additional material, the spikes will hold the previously compressed material in the compressed condition thereby substantially increasing the capacity of the container. As the container is gradually filled, the spikes are moved upwardly depending on the depth of the compressed material. Once the container is completely filled with compressed material, a cover member may be secured to the container and the spikes can be removed.

2. Description of the Prior Art

Numerous prior art investigators have discovered, taught, and disclosed a plethora of methods and/or means for compacting normally loosely packed materials into rigid or semi-rigid containers.

Examples of some prior art arrangement, as described above, can be found in the teachings and disclosure of U.S. Pat. No. 176,135, Herbert, Apr. 18, 1876, (directed to a Tobacco Press); U.S. Pat. No. 548,724, Rushton, Oct. 29, 1985, (directed to a Barrel Attachment); U.S. Pat. No. 1,242,232, Palm, (directed to a Waste-Paper Press); U.S. Pat. No. 1,448,779, Vowell et al., Apr. 28, 1922, (directed to a Press); U.S. Pat. No. 1,624,808, Scholten, Aug. 27, 1925, (directed to a Ham Presser); U.S. Pat. No. 1,852,195, Shaw, Apr. 5, 1932, (directed to a Mail Carrier Rack); U.S. Pat. No. 2,399,857, Connors, May 7, 1946, (directed to a Photograph and Letter Press); and U.S. Pat. No. 3,039,382, Simon et al., Dec. 9, 1958, (directed at an Apparatus for use in the Production of Shaped Meat Products).

Somewhat similar to the simple example referred to in the above section, in the tobacco press of Herbert supra, a screw press is utilized for compacting tobacco within a hogshead and each successive charge of tobacco is held in the compressed condition by the insertion of pins through the staves between the screw press follower and the tobacco to hold the tobacco compacted upon withdrawal of the screw press follower to allow the insertion of additional tobacco. The pins are connected to the base plate by means of an adjustable chain so that the pins can be moved upwardly as the hogshead is filled with each successive charge.

It will, of course, be appreciated by those skilled in this art that the use of spikes or pins extending through the side of the container to temporarily restrain the compacted material within the container is limited for use with particular materials. The provision of pins provides only limited contact with the compacted material and, depending upon the nature of the material, the material could expand or rebound past the pin. Also, if the material being compressed must be compacted in a sealed container, the provision of openings through the side of the container for the insertion of pins would, of course, be objectionable and represent a significant disadvantage.

In still another and more recent prior art arrangement, advanced for purposes of overcoming many of the distinct disadvantages attendant with the earlier attempts in this art to attain many of the objectives associated therewith, there is shown in U.S. Pat. No. 4,462,310, Jackson et al., July 31, 1984, a compacting device adapted to be inserted into a barrel or similar container provided with a base member having a plurality of upstanding rods secured to the base member in equally spaced relation about the periphery thereof. A support ring surrounds the upper ends of the rods, with each rod being secured to the interior surface of the ring. One or more compacting plates are provided which are adapted to fit within the ring for movement in a direction parallel to the rods. A plurality of spring locking plates equal in number to the rods are secured to the upper surface of the compacting plates for engagement with the rods which are provided with threads along substantially the entire length thereof. Thus, when loose material is placed in the container, and a compacting disc is inserted into the compacting device and pressed downwardly by any suitable press or the like, the material within the container will be compacted. The engagement of the locking plates with the threaded rods prevents the reverse movement of the compacting plate so that upon withdrawal of the press additional material can be added to the container for subsequent compaction.

Although this arrangement of Jackson et al. supra represents a significant advance of this art over the state wherein it existed prior thereto, I have found that it is fraught with a significant economic disadvantage in that the costs incurred in the manufacture thereof significantly increases the total cost of the end product, to wit, a filled and compacted mass of materials enclosed within a normally inexpensive disposal container, such as, for example, a fifty-five gallon drum. It will be appreciated that in some applications wherein such devices might be utilized, literally thousands and thousands of such drums might be filled and compacted and, accordingly, even a cost increase of just a few dollars would represent a significant percentage increase over the cost associated with the procurement of said drums. In addition, in some particular applications wherein the materials incorporated and compacted within such containers, including such drum, is, or could be, of a normally corrosive nature, chemical attack of the necessarily thin gauge of metal utilized in the construction of the spring locking plates might present a disadvantage in the use thereof.

SUMMARY OF THE INVENTION

The instant invention relates to apparatus suitable and adapted for use as a compacting device adapted to be inserted into a normally rigid container. Said compacting device generally comprises one or more compacting plates having a cross-sectional profile nearly matching the cross-sectional shape and dimensions of said container, and adapted to fit within the container for movement in a direction generally parallel to the loading orientation thereof.

A plurality of resilient locking tabs are secured by means of specially designed angle brackets to the compacting plates which plates are designed to be in contact with or to bear upon the material which is desired to be compacted within said container. In addition, said resilient locking tabs are relatively positioned upon such compacting plate in a manner so as to ensure that they extend beyond the peripheral surface or edge thereof for a length or dimension adequate and sufficient for contact and engagement with the inside surface of the container. In this embodiment of the instant invention, when relatively uncompacted material is placed in the container, and a compacting plate is inserted thereinto and driven home by any suitable means, the material within the container and juxtaposed said plate will be compacted. The resulting engagement of the resilient material tabs between the outer or "sealing" surface of the locking plate angle brackets and the inside peripheral surface of the container causes same to be deformed and wedged between the angle bracket and the inside surface of said container and thereby prevents the reverse movement of the compacting plate so that upon withdrawal of the pressure upon said compacting plate, additional material can be added to the container for subsequent compaction therein.

In a more specific application of this embodiment of the instant invention said locking tabs are comprised of rubber-like material and the container utilized is a common fifty-five gallon drum. As pressure is applied to the compacting plate, for purposes of compacting the materials within said drum, the rubber-like tabs are caused to ride along and across the inside surface of the drum in a manner such that they are caused to stretch in length. Such deformation of these rubber-like locking tabs is accompanied by a change in the thickness thereof which, along with attendant frictional forces causes them to be wedged between the outside surface of the angle brackets and the inside surface of said drum. Upon subsequent release of compacting pressure on the compacting plate, the rubber-like tabs tend to springback to their undeformed shape, but, of course, are prevented from doing so because of the physical restraints imposed thereupon by the outside edge of the locking plate angle brackets on one side thereof and the inside surface of the drum on the other side thereof. Although, not an absolute requirement, in the arrangement of one or more preferred embodiments of the instant invention, I have found that I can significantly increase the effectiveness thereof by biasing the "sealing" edge of said angle bracket slightly in a direction toward the inside edge of the container, i.e., the "right angle" of said bracket is increased by about 3 degrees. In this arrangement, said bracket edge, which is farthest disposed from said compacting plate, is slightly closer to the inside surface of said container wall and effectively "digs into" the resilient material of the locking tab to effect a better "bite" thereon.

Although the dimension that the locking tabs extend past the edge of the cmpacting plates is not normally highly critical as as long as it is sufficient to allow a portion thereof to engage the inside wall of the drum in frictional relationship so as to effect the deformation of at least a portion thereof to form the desired stop between said angle brackets and said drum wall, it will be appreciated by those skilled in the art of compaction that in some applications it would be desirable to predetermine said dimension to ensure that enough of the loose ends of said tabs resultingly extend up and beyond the upper surface of said angle bracket, after it has been driven home, so as to provide a sufficient length to ensure that the ends thereof extend beyond the point necessary to gain the greatest advantage of the "bite" provided by the "reverse" leading edge of the outermost surface of said angle bracket. Although the locking tabs on the compacting plate cause it to be not easily removable it has been proposed that said tabs may be provided with sufficient length such that there is provided a hold thereon to exert a pulling force sufficient to cause the deformation of same to effect a decrease in the thickness of the aforementioned resulting formed stop at the juncture between the angle bracket and the drum wall and to thereby provide means for release of said compacting plate from within said drum.

OBJECTS OF THE INVENTION

It is therefore the principal object of the present invention to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto.

Another object of the instant invention is to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto and wherein said materials have a propensity to return to the volume they occupied prior to the compaction thereof.

Still another object of the instant invention is to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto and wherein one or more compacting plates are utilized to compact and retain said materials in said containers with said materials being layered or sandwiched between said compacting plates when more than one of same is so utilized.

Still a further object of the instant invention is to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto wherein one or more compacting plates are utilized to compact and retain said materials in said containers with said materials being layered or sandwiched between said compacting plates when more than one of same is so utilized, and wherein the configuration of the inside of said containers is utilized as the guiding and/or tracking means for movement of said compacting plate(s) as said compacting plate(s) is moved into said container(s) for effecting said compacting of said materials.

Still another and further object of the instant invention is to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto wherein one or more compacting plates are utilized to compact and retain said materials in said containers with said materials being layered or sandwiched between said compacting plates when more than one of same is so utilized, and wherein the configuration of the inside of said containers is utilized as the guiding and/or tracking means for movement of said compacting plate(s) as said compacting plate(s) is moved into said container(s) for effecting said compacting of said materials and thereby eliminating requirements for separate guide and/or tracking means to be supplied and act in conjunction with said compacting plate(s).

A still further object of the instant invention is to develop a new method and means for easily, quickly, and economically compacting a variety of materials into rigid or semi-rigid containers, said new method and means having provisions for adding additional quantities of said materials to said containers, from time to time, and subsequently compacting same onto the materials previously compacted thereinto wherein one or more compacting plates are utilized to compact and retain said materials in said containers with said materials being layered or sandwiched between said compacting plate(s) when more than one of same is so utilized, and wherein the configuration of the inside of said containers is utilized as the guiding and/or tracking means for movement of said compacting plate(s) as said compacting plate(s) is moved into said container(s) for effecting said compacting of said materials thereby eliminating requirements for separate guide and/or tracking means to be supplied and act in conjunction with said compacting plate(s) and further eliminating the requirement for base plate means ordinarily first introduced into said container(s) and utilized as support means for such guide and/or tracking means.

Still further and more general objects and advantages of the present invention will appear from the more detailed description set forth below, it being understood, however, that this more detailed description is given by way of illustration and explanation only, and not necessarily by way of limitation since various changes therein may be made by those skilled in the art without departing from the true spirit and scope of the present invention.

BRIEF DESCRIPTION OF THE DRAWINGS

The present invention will be better understood from a consideration of the following description taken in connection with the accompanying drawings in which.

DETAILED DESCRIPTION OF THE PREFERRED EMBODIMENT

For the sake of clarity and a better understanding of the applicability of the diagrammatical illustrations introduced above, a more detailed description of same is given below.

Figure 1:
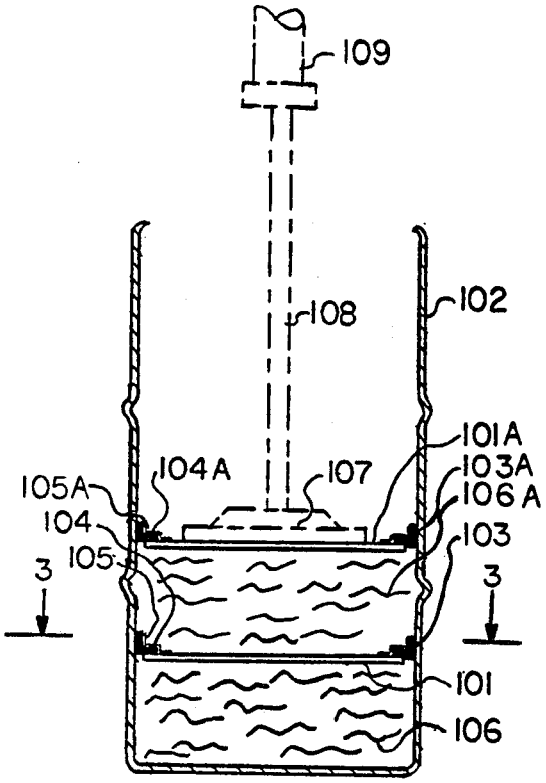
FIG. 1 shows a side elevation view of the compacting device according to the instant invention wherein two of said compacting plates are depicted as being located in a cylindrical drum and which cylindrical drum is shown in section as having press means for effecting the compacting of materials within said drum with said press means further being shown by means of phantom lines.

Referring now more specifically to FIG. 1, it will be appreciated by those skilled in this art that compacting plate 101 is shown to already be in compacted mode, i.e., it was previously introduced into container 102 on top of loose material 106 therein, driven home with compacting pressure applied thereto, and caused to be locked in place by means of three or more locking tabs 103 wedged between the inside surface of container 102 and the outside surface or edge 105 of angle bracket 104. It should be noted that the depiction herein is drawn to the preferred embodiments of the instant invention wherein both the tab and the compacting plate angle bracket are mounted upon the upper surface of the compacting plate (See FIGS. 6–13 for greater details). It will also be appreciated that compacting plate 101 is properly dimensioned to fit closely within the cylindrical walls of container 102, shown herein, for the sake of convenience, as a drum. Said compacting plate 101 has its outer edge extending nearly to the walls comprising the inside surface of container 102, leaving only the necessary clearance for said compacting plate 101 to move or be moved within said container 102 in a direction parallel to the cylindrical axis thereof. Compacting plate 101 is shown as a circular plate and may be constructed of any suitable strong, rigid material, such as, steel or the like.

As shown, a second compacting plate 101A having three or more locking tabs 103A is also in compacted mode atop of more previously introduced loose material, now shown as compacted material 106A, and in contact with pressure head 107, which pressure head 107 is driven by reciprocate plunger 108, which reciprocate plunger 108, is in turn activated by means of hydraulic cylinder 109.

Figure 2:
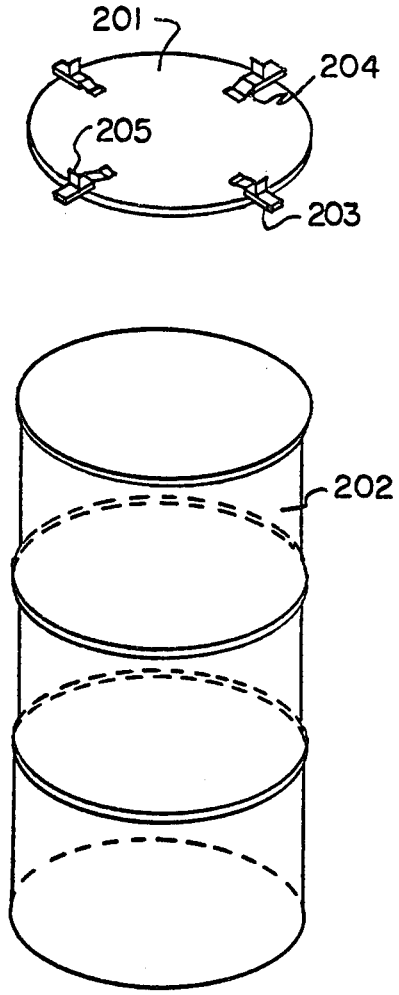
FIG. 2 depicts the instant invention with an exploded view of the compacting device showing a compacting plate for cooperation with the inside surfaces of the rigid or semi-rigid container means.
Figure 3:
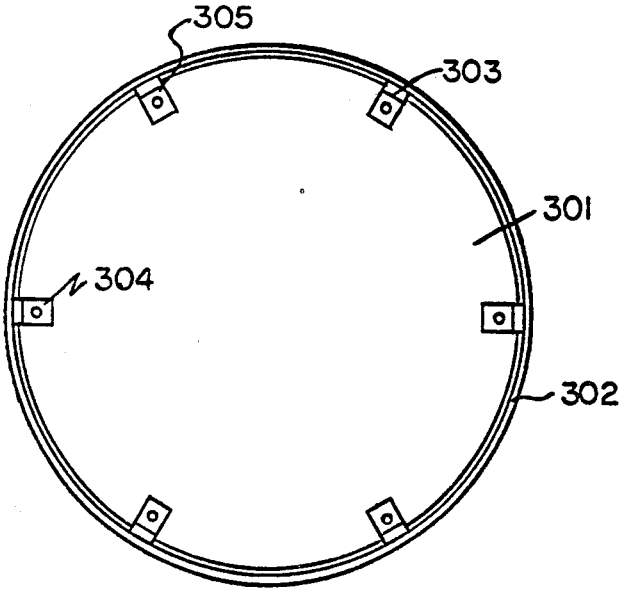
FIG. 3 is a cross-sectional top view of the device taken along line 3—3 of FIG. 1 showing an intermediate plate disposed within a cylindrical drum in locking engagement with the inside surfaces of the container into which compacting plate(s) of the instant invention have been introduced.

Referring more specifically to FIGS. 2 and 3, it may be seen that compacting plate 201 and 301, respectively, (for convenience, the notation "respectively" is understood to be applied, although it has been left out of, the remaining double references in this combined treatment of FIGS. 2 and 3), which compacting plate, of course, may be constructed of any suitable, strong, rigid material, is provided with a plurality of locking tabs 203 and 303, which locking tabs 203 and 303 are constructed of any suitable resilient material capable of being deformed by the application of tensile forces applied thereto so as to become wedged between the outer surface 205 and 305 of compacting plate angle bracket 204 and 304 and the inside surface of container 204 and 304. It will be appreciated, by those skilled in the art of material compacting, that the resulting effected wedging of locking tabs 203 and 303 forms an effective frictional stop between compacting plate 201 and 301 and the inside surface of container 202 and 302.

Referring again more specifically to FIG. 1, the operation of the compacting device of the instant invention is best seen by now referring back again thereto wherein first compacting plate 101 is inserted in container 102, which container 102 has previously been filled with a mass of material 106 to be compacted within container 102. Due to the looseness of material 106, said material 106 will initially substantially fill container 102. First compacting plate 101 which has been placed within the open end of container 102 is then pressed down in any convenient manner including, but not necessarily limited to, it being done manually until locking tabs 103, properly positioned on the upper surface of compacting plate 101 and the underside of angle bracket 204 and extending beyond the peripheral edge thereof engage the inside surface of container 102, which action, of course, causes locking tabs to be bent upwardly at approximately a ninety degree angle and to "ride" between the outside surface edge 105 of bracket 104. Subsequently, container 102 is placed within a press which might be of the type having a hydraulic cylinder 109 and a reciprocate plunger 108 having a pressure head 107 secured to the lower end thereof. Upon operation of the hydraulic piston and cylinder assembly, compacting plate 101 will be forced downwardly by pressure head 107 to compact material 106 to the greatest possible extent. Assuming that material 106, located between the bottom of container 102 and first compacting plate 101, as illustrated in FIG. 1, is fully compacted, pressure head 107 is withdrawn from container 102 to permit the introduction of additional material 106*a* into container 102 on top of first compacting plate 101. First compacting plate 101 will remain in the position shown in FIG. 1 to prevent previously compacted material 106 from rebounding or expanding. A seconding compacting plate 101*a* is then placed in the open end of container 102 and forced downwardly by the hydraulic piston and cylinder assembly to compact additional material 106*a*. Depending upon the nature of material 106 and 106*a*, any number of compacting plates, i.e., 101, 101*a*, etc., may be employed, with the last compacting plate engaging the inside surface of container 102 preferably at the upward end thereof.

Figure 4:
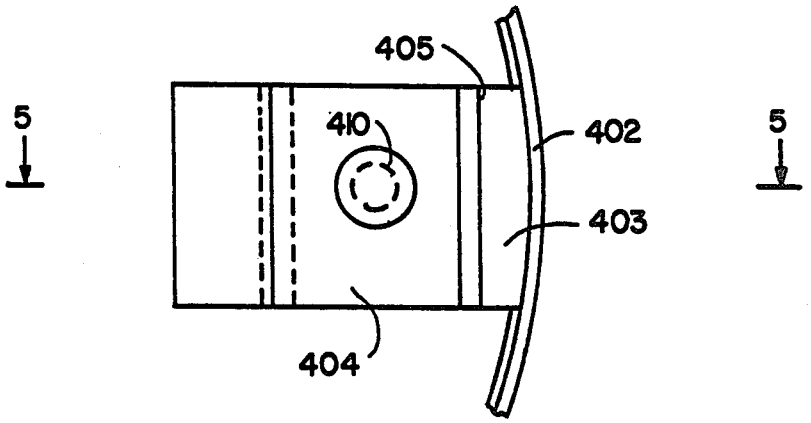
FIGS. 4 and 5 show respectively, a planer, as well as, an enlarged and detailed cross-sectional side view taken along line 5—5 of FIG. 4 of one showing the cooperation of a single locking "tab," mounted on the bottom surface of said compacting plate and juxtaposed the edge thereof and being bent over after insertion of said compacting plate into the container. As shown, the attendant resilient material of the tab is in contact with a locking plate angle bracket, which angle bracket is shown mounted on the top surface of said compacting plate and which tab is shown mounted on the bottom surface of said compacting plate, is in contact with the inside surface of the container into which said compacting plate having said locking tab properly affixed thereto has been inserted.
Figure 5:
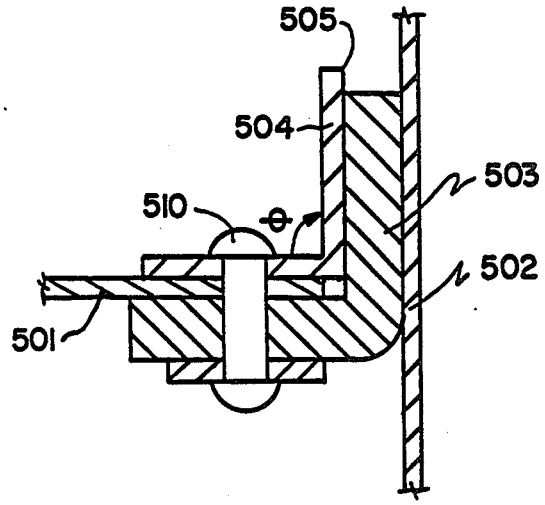

Referring now more specifically to FIGS. 4 and 5, there is shown a planer view, as well as, a detailed enlarged cross-sectional view, on the line 5—5 of the earliest embodiment of the instant invention depicting the cooperation of single locking tab 503 between outside surface 505 of angle bracket 504 and inside surface of container 502. Locking tab 503 is shown properly affixed upon the bottom surface of compacting plate 501. Angle bracket generally illustrated at 504, is shown as mounted upon the upper surface of plate 501. In this first, and nonpreferred, embodiment of the instant invention the rigidity of angle bracket 504 stock is relied upon to effect the force of outermost edge 505 onto tab 503, although, any of the various gusset arrangements shown in later depictions for the more preferred embodiments of the instant invention may, of course, be utilized. Angle bracket 504 is shown secured to compacting plate 501 by means of rivet 510. In this depiction, compacting plate 503 has already been inserted into container 502, in the manner described in the more detailed description of FIG. 1 supra, so as to cause application of frictional and tensile forces thereupon to cause the resulting information of locking tab 503, i.e., the bending, stretching, and resulting thinning thereof. Upon release of the forces exerted on compacting plate 501 by the pressure head not shown, the propensity of material not shown thereunder to rebound, or to springback towards its uncompacted volume will initially cause compacting plate 501 to be forced to move in the direction opposite to that first induced by the action of the pressure head. As compacting plate 501 so begins to move in said opposite direction, even a small increment of such movement will effect the stretched portion of locking tab 503 to wedge and to become bunched up (not shown) in the area between the outer surface 505 of angle bracket 504 and that portion of the inside of container 402 substantially opposite thereto, to thereby effect the formation of an effective, and positive stop. Angle theta is shown generally as a right angle, but as will become readily apparent from discussions infra, theta may vary from about 90 degrees to about 110 degrees and preferably from about 92 degrees to about 100 degrees, and most preferably from about 92 degrees to about 94 degrees, with the angle of bias of the outermost "bearing" surface 505 of bracket 504 being theta minus 90 degrees. As will also become apparent from later discussions, theta normally is set at 93 degrees +/−1 degree, i.e., the angle of forward bias of outer edge 505 of bracket 504 can vary from a couple of degrees to as much as 10 to 20 degrees, but normally is set at about 3 degrees.

Figure 6:
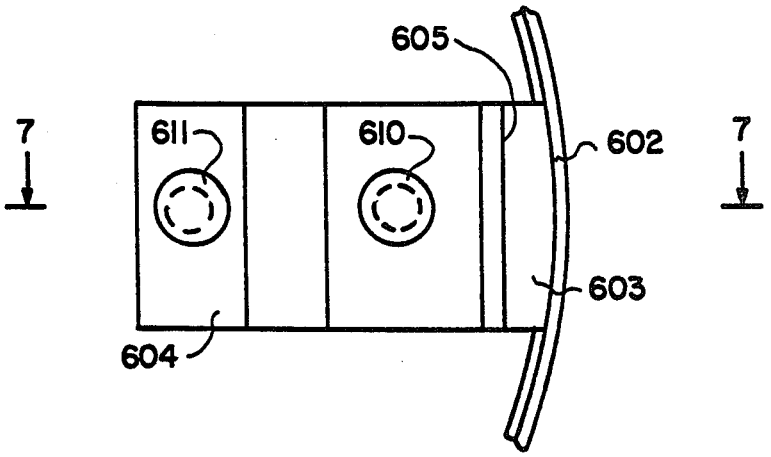
FIGS. 6, 8, 10, and 12 show various planer views
Figure 7:
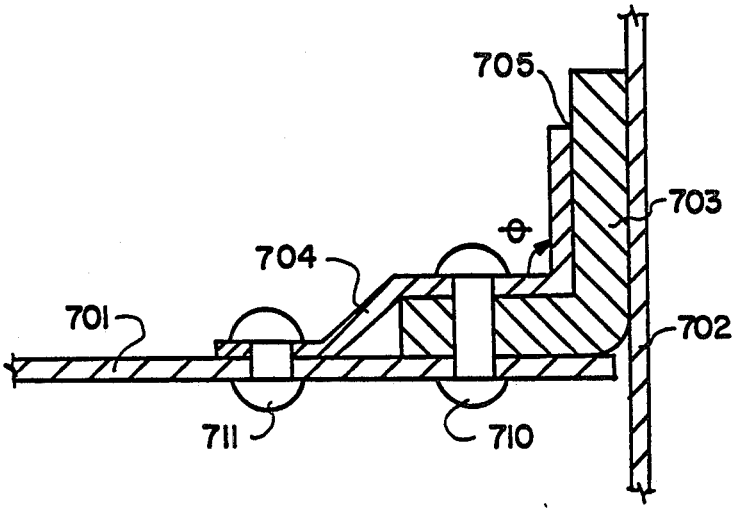
FIGS. 7, 9, 11, and 13 show enlarged detailed cross-sectional side views thereof taken along lines 7—7, 9—9, 11—11, and 13—13 of FIGS. 6, 8, and 10, respectively, of the preferred embodiments of the instant invention showing the cooperation of a single locking "tab," juxtaposed the edge of a compacting plate with attendant resilient material in contact with a locking plate angle bracket, which bracket in these embodiments is shown mounted atop the tab, which tab in turn is shown mounted upon the upper surface of said compacting plate and said tab being "squeezed" between the outside "bearing" edge of said compacting plate angle bracket and the inside surface of the container into which said compacting plate having said locking tab properly affixed thereto has been inserted. For the sake of clarity and a better understanding of the invention a more detailed description of these drawings is given infra in combination with the discussions of tests comprising Examples II, III and IV, respectively.

Referring now more specifically to FIGS. 6 and 7, there is shown a planer view, as well as, a detailed enlarged cross-sectional view, on the line 7—7 of the preferred embodiment of the instant invention depicting the cooperation of single locking tab 703 between outside surface 705 of angle bracket 704 and inside surface of container 702 onto which compacting plate 701, locking tab 703 has been properly affixed thereto by means of angle bracket generally illustrated at 704. In this embodiment of the instant invention the rigidity of angle bracket 704 stock is relied upon to effect the force of outermost edge 705 onto tab 703, and angle bracket 704 is shown secured to compacting plate 701 by means of rivets 710 and 711. In this depiction, compacting plate 703 has already been inserted into container 702 in the manner described in the more detailed description of FIG. 1 supra so as to cause application of frictional and tensile forces thereupon to cause the resulting deformation of locking tab 703, i.e., the bending, stretching, and resulting thinning thereof. Upon release of the forces exerted on compacting plate 701 by the pressure head not shown, the propensity of material not shown thereunder to rebound, or to springback, towards its uncompacted volume will initially cause compacting plate 701 to be forced to move in the direction opposite to that first induced by the action of the pressure head. As compacting plate 701 so begins to move in said opposite direction, even a small increment of such movement will effect the stretched portion of locking tab 703 to wedge and to become bunched up (not shown) in the area between the outer surface 705 of angle bracket 704 and that portion of the inside of container 702 substantially opposite thereto to thereby effect the formation of an effective, and positive stop.

Figure 8:
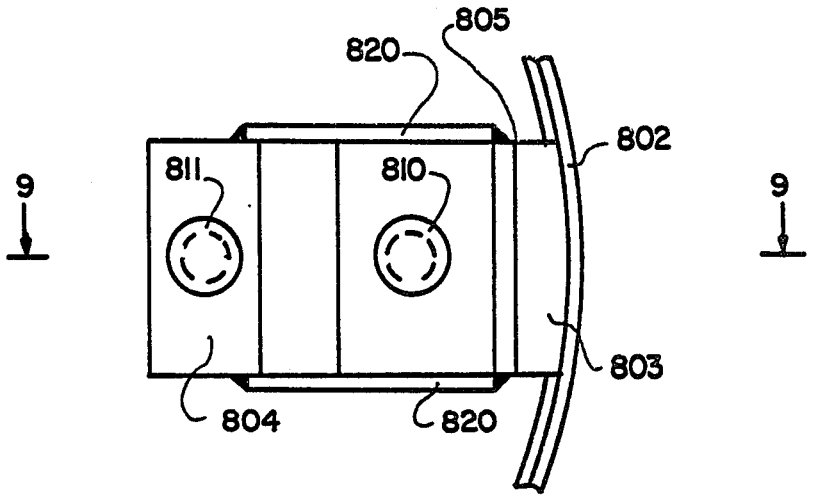
Figure 9:
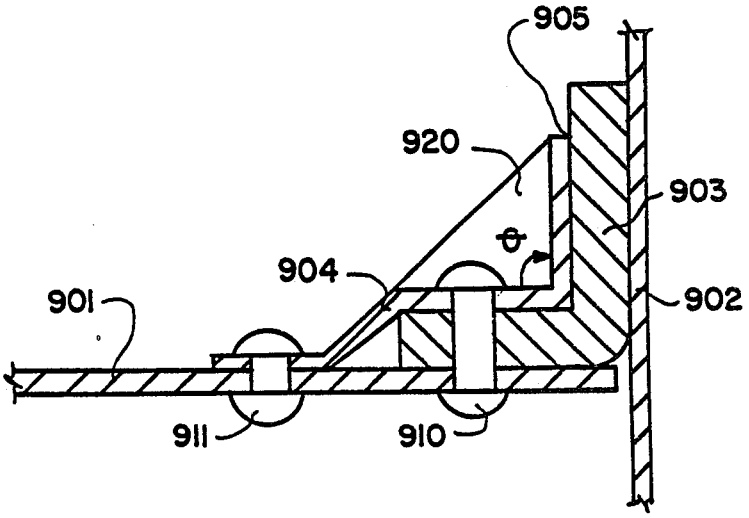
Figure 10:
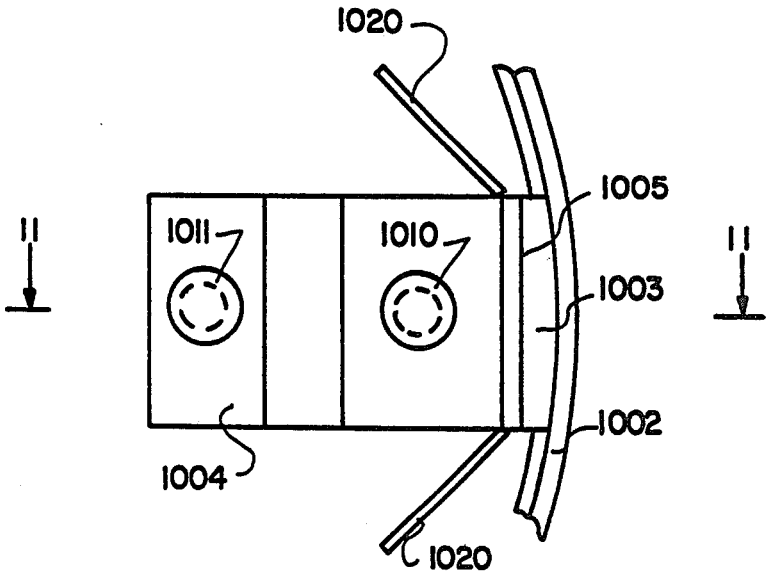
Figure 11:
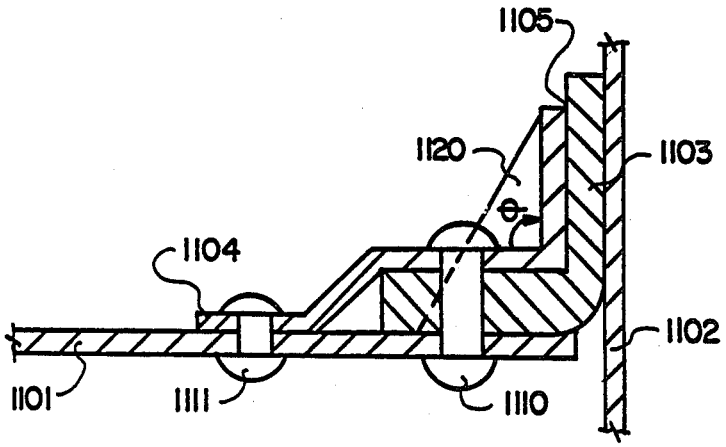
Figure 12:
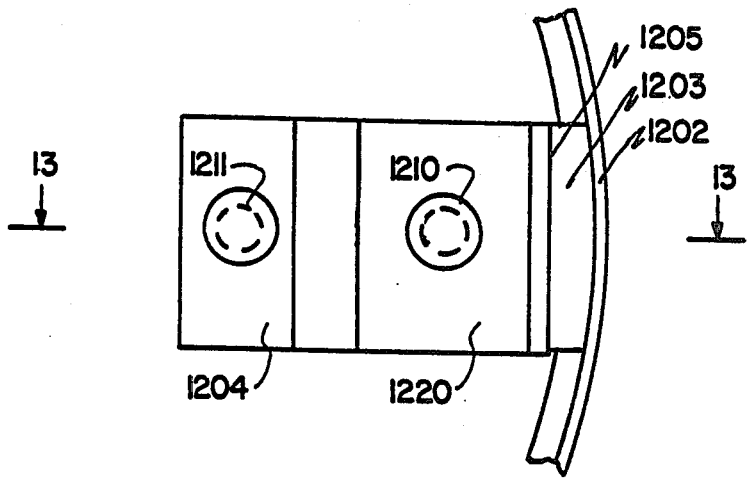
Figure 13:
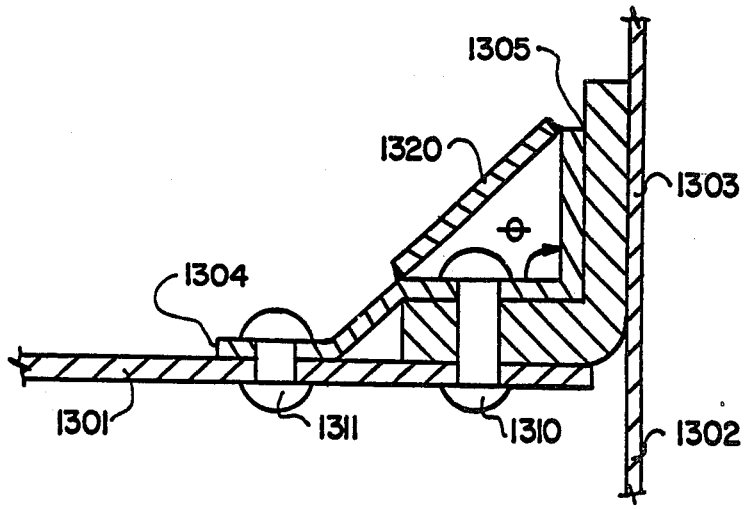

Referring now more specifically to FIGS. 8–13, it will be seen that in FIGS. 8, 10, and 12 there is shown essentially the same view as in FIG. 6, and that the logic of presenting such a respective detailed and enlarged and accompanying cross-sectional side view, as in FIG. 7, is repeated, i.e. taken along lines 9—9, 11—11, and 13—13 of FIGS. 8, 10, and 12 in FIGS. 9, 11, and 13, respectively except that as illustrated thereon, three different gusset arrangements 920, 1120, and 1320 are utilized for purposes of adding rigidity to the respective angle brackets. These gussets are shown on the respective planer views comprising FIGS. 8, 10, and 12. It is noted that in these FIGS. 8–13, the same logic of presentation or format is followed as was used in FIGS. 4 and 5 as well as in FIGS. 6 and 7 supra. Accordingly, x01 represents the respective connecting plates of each set, i.e., 901 or 1101 or 1301. Likewise, x02 denotes the container, x03 the locking tab, x04 the angle bracket, x05 the outermost edge or "bearing" surface, and x10 together with x11 the rivets or other attachment means. As will be appreciated from the more detailed discussion below, such provisions for added rigidity are to be considered to be the most preferred embodiments of the instant invention, particularly when the added preferred provision for biasing the outermost edge 905, 1105, and 1305 of the respective angle brackets for obtaining a better "bite" on the associated tabs is considered. It should, of course, be appreciated that, although the means to secure the angle brackets to the compacting plates are shown by means of rivets, other suitable means, such as, bolting or tack welding, can be substituted therefore with suitable means provided to positively secure said tabs, to the assemblies as shown.

EXAMPLES

In order that those skilled in the art may better understand how the present invention can be practiced, the following examples are given by way of illustration only, and are not intended for purposes of indicating limitations and/or restrictions on the breadth and/or scope encompassed by the various embodiments of said invention, including, but not necessarily limited to, the embodiments illustrated herein since certain practicalities have been limiting factors for purposes of this presentation.

EXAMPLE I

In the pursuit of further information gathered for the purpose of more clearly defining the parameters affecting the practice of the instant invention, the investigations herein were made to determine both the locking and the release response of various configurations of locking tabs and physical dimensions thereof. Although, it is understood that any number and types of container configurations can be employed in the practice of the instant invention, the tests comprising this example were conducted using standard fifty-five gallon steel drums of the type normally readily available for packing and compacting materials intended for waste disposal, including rags, clothing, and other incidental fabric articles which have become contaminated with relatively low levels of nuclear radiation. A first series of tests were run in which the tabs used were constructed of Neopreme rubber and the thickness thereof was nominally $\frac{3}{8}$ inch. In this first approach, no angle brackets were utilized and the resilient material locking tab was affixed to the underside or bottom surface of the compacting plate in a manner to extend beyond the peripheral of said plate such that when said plate was introduced into a drum and onto material therein to be compacted by means of subsequent application of pressure via a power ram or the like, a portion of the resilient material tab was "squeezed" between the outer edge of said plate and the inside surface of said drum. The Neopreme rubber tabs were secured to the plate by means of bolting same thereto through predrilled holes therein. In this series of tests for checking out this embodiment a total of 12 disks were utilized and tested and in all cases the objectives of the instant invention were not realized, presumably because of the lack of sufficient or proper contact surface between the rubber tab and the side of the drum. Accordingly, the next arrangement that was utilized was the deployment of the added bearing surface provided by means of adding angle brackets to the top side of the compacting plate as is shown in FIGS. 4 and 5 supra. This embodiment greatly improved upon my first embodiment, but left me with an arrangement that was somewhat less than desirable as far as an assembly that was easy to handle and manipulate.

EXAMPLE II

In the pursuit of still further information for the purpose of still more clearly defining the parameters affecting the practice of the instant invention the following investigations were designed to determine the effectiveness of various configurations of locking tabs and physical dimensions thereof. In the tests comprising this example, test configurations and equipment similar to that utilized in Example I supra was repeated except that an improved method of securing the tabs was tested. In the tests comprising this example, compacting disks were constructed with the rubber tab attached by means of my specially designed angle brackets, as shown in FIGS. 6 and 7, with no provisions being made for the use of means for adding extra rigidity to the angle bracket in order to keep the "reverse" leading edge of same biased outwardly toward the inner surface of the inside surface of the container by about 3 degrees. Although the disks and tests thereof worked reasonably well, as noted below, the much more preferred arrangement is to utilize such angle brackets with appropriately mounted gussets.

EXAMPLE III

In keeping with the findings from Example II above, and in the pursuit of still more useful and pertinent information for the purpose of still more clearly defining the parameters affecting the practice of the instant invention, the following investigations were designed to determine the effectiveness of various configurations of gussets as well as of tabs and angle brackets. In the tests comprising this example, test configurations and equipment similar to that utilized in Example II supra was repeated except that an improved method of securing the gussets were tested. In the tests comprising this example, compacting disks were constructed with the rubber tab attached by means of my specially designed angle brackets and gussets, as shown in FIGS. 8 and 9, and the disks and tests thereof worked well, as noted below.

In these tests, since the typical inside dimensions of such drums are normally from about $22\frac{3}{8}$ to about $22\frac{1}{2}$ inches, the compacting plates used had a nominal diameter of from about $22\frac{1}{4}$ to about $22\frac{3}{8}$ inches. The plates were constructed of type A569 steel and were 0.109 inches in thickness, said thickness being sufficient to sustain a loading of at least about 120 pounds per square inch.

To each such compacting plate a plurality of locking tabs, each in turn measuring $2\frac{1}{2}$ inches in length, $1\frac{1}{2}$ inches in width, and $\frac{3}{8}$ inches in thickness, were affixed by means of said specially designed angle brackets supra. The tabs were constructed from Neopreme type rubber. In one series of tests, four of said tabs were attached to each plate equidistant about the outside diameter thereof. The method of fixing same via the angle brackets to the plates was by means of using $\frac{3}{8}$-inch diameter steel cap screws of length sufficient to secure said angle brackets by means of one appropriately sized hole, for each such bracket, previously drilled through said plates about $\frac{3}{4}$ inch from the edge of said plates. In this arrangement, about $1\frac{1}{2}$ inches of tabs were left extending beyond the edge of said plate. In another series of tests comprising this example, six tabs each were so affixed to each plate, and again the tabs were equally spaced about the circumference of each plate.

To each drum, about 150 pounds of contaminated fabrics of an effective specific gravity ranging from about 0.50 to about 2.0 pounds per cubic foot were added. A first compacting plate of the type having four tabs affixed in the manner supra was inserted into the opening of the drum and manually pushed down thereinto. A power ram was then utilized to drive the compacting plate downwardly with a force of about 21,200 pounds which equated to about 56 pounds per square inch of compacting load on said fabric in the drum. At the time of release of the power ram upon said plate, the effective "springback" or rebound of the compacting plate was observed to be less than about 1.0 inch. Subsequently, another charge of about 150 pounds of fabric was added to the drum and a second compacting plate was placed thereover and subjected to the action of said power ram. Again, the effective springback of the fabric was observed to be less than about 1.0 inch. In all, each drum in this test had from two to three plates placed and rammed thereinto. Likewise, several drums were also tested by filling and compacting wherein the compacting plates each had six tabs affixed thereto. In these tests, the effective rebound of the material in the drums, after release of the power ram, was observed to range from abouut $\frac{1}{2}$ inch to about $\frac{3}{4}$ inch. Since the reduction in effective rebound in this series of tests was essentially insignificant, it was concluded that for purposes of compacting materials of the general type handled therein, usually no more than six such tabs would be necessary in most applications.

EXAMPLE IV

As noted in Example III supra, the configuration of the locking tab with the angle bracket shown therein yielded results commensurate with the stated objectives of the instant invention. In the series of tests comprising this example there was employed the use of angle bracket arrangements similar to that shown in FIGS. 8 and 9 supra, however, the location of the gussets was changed to a different location as shown in FIGS. 10–13.

Tests IVa

In the tests comprising this subseries, the gussets referred to above were located as shown in the views of the apparatus, i.e., the gussets used in these tests were angled horizontally outwardly from the outer most edge of the angle bracket by about 45 degrees. In these tests 48 disks were constructed with tabs as shown in FIGS. 10 and 11. On each compacting plate six tabs were used and attached to the plate by means of the angle brackets which in turn were affixed by means of quarter-inch bolts or quarter-inch rivets, or were tack welded thereto. Two gussets, one on each side of the angle bracket, were positioned at about 45 degrees to the long edge of the rubber tab and secured to the upper surface of the compacting plate for purposes of adding rigidity to the assembly. The results of the tests with this arrangement were all positive with springback of the compacting plates observed to be generally less than about ½ an inch.

Tests IVb

In the tests comprising this subseries of the instant example, 12 disks were constructed with a single gusset arrangement as illustrated in FIGS. 12 and 13 wherein a single gusset was tack welded to the L-shaped portion of the angle bracket for purposes of rigidity as in subtest IVa supra, but at a reduced cost. The angle brackets were secured to the locking plates by the use of quarter-inch bolts or quarter-inch rivets or the employment of tack rivets and six tab assemblies were arranged equidistant around the peripheral edge of the locking plate. The results of the tests on these disks were positive and again the observed springback of the compacting plate was generally less than about ½ an inch. As shown in these FIGURES the leading edge of the angle bracket is pitched forwardly slightly such that, assuming a vertical drum wall, it is off the vertical by about three degrees plus or minus one degree. This small amount of forward biasing has been observed to greatly enhance the holding ability of the overall assembly apparently causing a slight, but significantly important, linearly distortion of the rubber locking tab along the length thereof engaged along the inner wall of the container and causing the edge of the angle bracket which is furthermost disposed from said compacting plate to "dig in" to the surface of the rubber tab and provide a better "bite" thereon. Although 3 degrees is the angle mentioned herein, it will, of course, be realized that a somewhat greater angle of forward biasing may be utilized as long as it allows for the relatively free movement of the compacting plate assembly into the container and does not unnecessarily interfere with the proper deformation and stretching of the tabs therein.

It will be apparent to those skilled in this art that various modifications can be made to the instant invention without departing from the true scope and spirit thereof, as for example, constructing the plates out of finer guage material, divising various configurations of the plates in relationship to providing reinforcing and/or rigidity to same, particularly when they are constructed out of such finer guage material, and providing means for effecting coupling with that end of the tabs which extends upwards and beyond the edge of the bent bracket such as an aperture in said locking tab whereby one or more disks which have been pressed into a drum could subsequently be removed by pulling on and stretching the tab for effecting release of the stop provided thereby.

INVENTION PARAMETERS

The operating variables including the acceptable and preferred conditions for carrying out my invention are summarized below:

| Variables | Limits | Preferred |
|---|---|---|
| Clearance gap between edge of plate and container wall in inches | 1/16–1/8 | 1/16 |
| Ratio of plate area to ram head area | 3:1 to 0.95:1 | 2.5:1 to 0.95:1 |
| Ratio of tab thickness to clearance gap | 4.5 ± 1.5:1 | 6:1 |
| Ratio of tab extension to plate thickness | 12 ± 2:1 | 12:1 |
| Ratio of tab extension to tab thickness | 4 ± 1:1 | 4:1 |
| Ratio of tab extension to clearance gap | 12 ± 4:1 | — |
| Number of tabs per plate | 3–12 | 6 |
| Tab materials of construction | Soft pliable rubber | Neopreme |
| Number of plates used per compaction | 1–6 | 3 |
| Allowed loading on plate in psi | — | 95 |
| Ram pressure applied to each plate during each compaction | — | 37.7 kg |
| Angle of forward biasing of "reverse" leading edge of bracket (theta minus 90 degrees) | 0–20 | 2–10 (2–4)* |

*Most preferred.

While I have shown and described particular embodimentes of my invention, modifications and variations thereof will occur to those skilled in the art. I wish it to be understood therefore that the appended claims are intended to cover such modifications and variations which are within the true spirit and scope of my invention.

What I claim as new and desire to secure by Letters Patent of the United States is:

1. A compacting device of the type adapted to be closely fitted within a container having one end thereof closed and having an opening at the opposite end thereof, and adapted for compacting material within said container with a ram head and maintaining the material in compacted condition, said compacting devise comprising:

(1) at lease one generally non-removable compacting plate member having a top surface, a bottom surface, a peripheral configuration complementary to the cross-sectional dimensions of said container, and adapted to be placed withing said opening of said container, and (2) a plurality of locking means secured to said compacting plate, juxtaposed the peripheral edge thereof and disposed in movable engagement with the inside walls of said container to permit movement of said compacting plate towards the closed end of said container while preventing movement of said compacting plate in the opposite direction, said locking means comprising:

(a) angle brackets having a first and a second leg with said first leg having a substantial top and bottom surface and a portion thereof juxtaposed and fixedly secured to the upper surface of said compacting plate, and (b) locking tabs comprising a resilient material having a first portion thereof juxtaposed the top surface of said compacting plate and the bottom surface of at least a portion of said first leg of said angle bracket which is not in contact with said plate surface but is substantially parallel therewith, and a second portion of said locking tab extending substantially beyond said peripheral edge of said compacting plate.

2. A compacting device as set forth in claim 1 wherein said locking tabs are characterized as being relatively easily deformed, and further, wherein the extension of said locking tabs beyond the peripheral configuration of said compacting plate is for a distance sufficient to frictionally engage the inside wall surface of said container and to become physically deformed, at least in the thickness dimension thereof, sufficient to effect a juxtapositioning of said tabs with said angle brackets and said inside surface of said container during movement of said compacting plate to thereby form a stop for effecting said prevention of movement of said compacting plate in said opposite direction.

3. A compacting device as set forth in claim 1 wherein said locking tabs are secured to that side of said compacting plate opposite the direction of compacting movement thereof, during effecting of compacting material in said container, said angle bracket having a dimension substantially parallel and opposite to said compacting plate movement towards the closed end of said container sufficient to provide sufficient bearing surface area for one side of said locking tab to effect the other side thereof to frictionally engage the inside wall surface of said container and to become physically deformed, at least in the thickness dimension thereof, sufficient to effect a juxtapositioning of said tabs with the outside edge of said angle bracket and the inside surface of said container during movement of said compacting plate to thereby form a stop for effecting said prevention of movement of said compacting plate in said opposite direction.

4. A compacting device as set forth in claim 3 wherein the dimension of said angle bracket which is substantially parallel and opposite to said compacting plate movement is inclined at an angle ranging upwards to about 20 degrees from true parallel with the inside wall surface of said container and in a direction toward same.

5. A compacting device as set forth in claim 4 wherein said angle ranges from about 2 degrees to about 10 degrees.

6. A compacting device as forth in claim 5 wherein said angle ranges from about 2 degrees to about 4 degrees.

7. A compacting device as set forth in claim 4 wherein said plurality of locking tabs ranges from about 3 to about 12.

8. A compacting device as set forth in claim 7 wherein said plurality of locking tabs comprises about 6.

9. A compacting device as set forth in claim 8 wherein the ratio of the dimension of thickness of said locking tabs to the dimension of distance between the outside edge of said angle brackets of said compacting plate and said inside surface of said container ranges from about 3:1 to about 6:1.

10. A compacting device as set forth in claim 9 wherein the ratio of the dimension of thickness of said locking tabs to the dimension of distance between the outside edge of said angle brackets of said compacting plate and said inside surface of said container is about 3.0:1.

11. A compacting device as set forth in claim 9 wherein the ratio of the dimension that said tabs extend beyond the peripheral configuration of said angle brackets of said compacting plate to frictionally engage the inside wall surface of said container and the dimension of distance between the outside edge of said angle brackets of said compacting plate and said inside surface of said container ranges from about 8:1 to about 16:1.

12. A compacting device as set forth in claim 8 wherein the ratio of the dimension that said tabs extend beyond the peripheral configuration of said angle brackets of said compacting plate to frictionally engage the inside wall surface of said container and the dimension of thickness of said compacting plate ranges from about 10:1 to about 14:1.

13. A compacting device as set forth in claim 8 wherein the ratio of the area of said compacting plate to the area of the ram head engaging said compacting plate ranges from about 3:1 to about 0.95:1.

14. A compacting device as set forth in claim 13 wherein the ratio of the area of said compacting plate to the area of the ram head engaging said compacting plate ranges from about 2.5:1 to about 0.95:1.

15. A compacting device of the type adapted to be closely fitted within a container having an opening at one end thereof and adapted for compacting material within said container and maintaining the material in compacted condition, said compacting devise comprising:

(a) at least one generally non-removable compacting plate member having a peripheral configuration complementary to the cross-sectional dimensions of said container and adapted to be placed within said opening of said container;

(b) bearing surface means comprising a generally right angled member and having a first leg thereof fixedly secured to said compacting plate and juxtaposed the periphery thereof; and (c) locking tabs means having two planar surfaces substantially parallel to one another and substantially parallel to said compacting plate, said locking tab means comprising a resilient material having a first portion fixedly secured to said compacting plate, and a second portion extending substantially beyond the peripheral edge of said compacting plate and disposed in a manner such that when said compacting plate member is placed within said opening of said container, said second portion of said locking tab is deflected substantially at a right angle from its original orientation and deformed in a manner to effect a positive stop between said bearing surface means and the inner wall of said container.

16. A compacting device as set forth in claim 15 wherein said bearing surface means is aligned at about an angle ranging from about 90 degrees to about 110 degrees to the plane of said compacting plate member.

17. A compacting device as set forth in claim 16 wherein said bearing surface means is aligned at about an angle ranging from about 92 degrees to about 100 degrees to the plane of said compacting plate member.

18. A compacting device as set forth in claim 17 wherein said bearing surface means is aligned at an angle ranging from about 92 degrees to about 94 degrees to the plane of said compacting plate member.

19. A compacting device as set forth in claim 16 wherein the length of said second portion of said locking tab means is greater than the length of a second leg of said bearing surface member means.

* * * * *